US008092916B2

(12) United States Patent
Takeda et al.

(10) Patent No.: US 8,092,916 B2
(45) Date of Patent: Jan. 10, 2012

(54) STEEL WIRE ROD

(75) Inventors: Mikako Takeda, Kobe (JP); Shohei Nakakubo, Kobe (JP); Takashi Onishi, Kobe (JP); Masumi Nishimura, Kakogawa (JP); Hidenori Sakai, Kakogawa (JP); Tomotada Maruo, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 241 days.

(21) Appl. No.: 12/409,679

(22) Filed: Mar. 24, 2009

(65) Prior Publication Data

US 2009/0269578 A1 Oct. 29, 2009

(30) Foreign Application Priority Data

Apr. 28, 2008 (JP) ..... 2008-117331

(51) Int. Cl.
*B32B 15/02* (2006.01)
*B32B 15/04* (2006.01)

(52) U.S. Cl. ..... 428/472.2; 428/328; 428/329; 428/472; 428/472.1; 428/701; 428/702; 428/336

(58) Field of Classification Search ..... None
See application file for complete search history.

(56) References Cited

U.S. PATENT DOCUMENTS 3,645,805 A * 2/1972 Hoffmann et al. ..... 148/596
5,244,751 A * 9/1993 Takayama et al. ..... 428/836.2
6,602,359 B1 * 8/2003 Ochi et al. ..... 148/330
6,866,724 B2 * 3/2005 Ochi et al. ..... 148/320
2003/0075250 A1 * 4/2003 Ochi et al. ..... 148/654
2005/0264958 A1 * 12/2005 Shvets et al. ..... 360/327.32
2007/0125455 A1 * 6/2007 Yoshihara et al. ..... 148/332

FOREIGN PATENT DOCUMENTS

EP 1 921 172 A1 5/2008
JP 1-255627 10/1989
JP 4-293721 10/1992
JP 8-295992 11/1996
JP 10-324923 12/1998

(Continued)

OTHER PUBLICATIONS

A. Chattopadhyay, et al., "Study on formation of "easy to remove oxide scale" during mechanical descaling of high carbon wire rods", Surface & Coatings Technology, vol. 203, No. 19, XP002531749, Jun. 25, 2009, pp. 2912-2915.

(Continued)

*Primary Examiner* — Jennifer McNeil
*Assistant Examiner* — Vera Katz
(74) *Attorney, Agent, or Firm* — Oblon, Spivak, McClelland, Maier & Neustadt, L.L.P.

(57) ABSTRACT

An FeO layer including fine crystal grains having random orientation is formed as inner layer scale on the surface of the steel wire rod containing C: 0.05-1.2 mass % (hereinafter referred to as "%"), Si: 0.01-0.50%, Mn: 0.1-1.5%, P: 0.02% or below, S: 0.02% or below, N: 0.005% or below, an $Fe_2SiO_4$ layer with the thickness: 0.01-1.0 μm is formed in the boundary face between the FeO layer of the inner layer scale and steel, and the thickness of the inner layer scale is 1-40% of the total scale thickness. In another aspect, the maximum grain size of the crystal grain of the inner layer scale is 5.0 μm or below and the average grain size is 2.0 μm or below.

13 Claims, 2 Drawing Sheets

FOREIGN PATENT DOCUMENTS

| | | | | |
|---|---|---|---|---|
| JP | 11-172332 | | | 6/1999 |
| JP | 2006-28619 | | | 2/2006 |
| JP | 2007070728 | A | * | 3/2007 |
| JP | 2007217790 | A | * | 8/2007 |
| JP | 2008-57008 | | | 3/2008 |
| KR | 10-2008-0036081 | | | 4/2008 |
| WO | WO 2007/020916 | A1 | | 2/2007 |

OTHER PUBLICATIONS

Notice of Preliminary Rejection issued Mar. 29, 2011, in Korean Patent Application No. 10-2009-0035279, filed Apr. 23, 2009 (with English translation).

* cited by examiner (NOTE) {100} IS THE MAIN ORIENTATION OF FeO(WUSTITE)

STEEL WIRE ROD

BACKGROUND OF THE INVENTION

1. Field of the Invention

The present invention belongs to a technical field in relation with a steel wire rod, particularly to a technical field in relation with a steel wire rod excellent in scale adhesion properties (the scale is hard to be detached) during cooling after hot rolling and during storage and transportation (during storage, during transportation), and excellent in scale detachment properties during mechanical descaling.

2. Description of the Related Art

On the surface of the steel wire rod (hereinafter referred to also as "wire rod") manufactured by hot rolling, the scale is formed, and it is necessary to remove the formed scale prior to wire drawing and the like of secondary working of the wire rod. In wire drawing of the wire rod in recent years, from the viewpoints of pollution problems and cost reduction, the method of removing scale is changing from the acid washing method by batches to the mechanical descaling method. Therefore, it is desired to develop the wire rod whose scale can be easily detached in mechanical descaling (hereinafter referred to also as "MD"), in other words, the wire rod with the scale characteristics excellent in MD properties.

From such viewpoints, the technologies described below have been disclosed as the manufacturing methods of the wire rod having the scale characteristics excellent in MD properties.

(1) The method for decreasing the residual scale quantity in the wire rod by increasing FeO ratio or decreasing $Fe_3O_4$ ratio in the scale and increasing the thickness of the scale (the Japanese Unexamined Patent Application Publication No. H4-293721, the Japanese Unexamined Patent Application Publication No. H11-172332).

(2) The method for lowering the boundary face roughness in order to prevent the anchor effect by biting in of the scale (the Japanese Unexamined Patent Application Publication No. H8-295992).

(3) The method for improving the scale detachment properties by including the blow hole in the scale and lowering the strength of the scale (the Japanese Unexamined Patent Application Publication No. H10-324923, the Japanese Unexamined Patent Application Publication No. 2006-28619).

SUMMARY OF THE INVENTION

However, because such conventional technologies involved the problems described below, they could not be regarded as the fully adequate methods.

According to the methods described in the Japanese Unexamined Patent Application Publication No. H4-293721 and the Japanese Unexamined Patent Application Publication No. H11-172332, decrease of yield is caused because the scale is formed thick. Also, even if bending strain is applied to the wire rod by MD method and brushing is performed on the surface, it is difficult to entirely remove the scale, it is hard to perform scale removing process evenly on the entire surface and stably, and finely pulverized scale dust may possibly be dotted on the surface of the wire rod, which is different from the case of the acid washing by batches. If such residual scale locally left increases, problems such as generation of a flaw due to lubricating defect in the drawing process and deterioration of the life of the dice are caused, therefore it is not necessarily a fully adequate method.

With regard to the method for improving the MD properties by lowering the boundary face roughness (the technology described in the Gazette of the Japanese Unexamined Patent Application Publication No. H8-295992), it is difficult to stably obtain the boundary face roughness at a target value or below, and it is hard to perform the scale removing process stably.

With regard to the method for including the blow hole within the scale (the technology described in the Gazettes of the Japanese Unexamined Patent Application Publication No. H10-324923 and the Japanese Unexamined Patent Application Publication No. 2006-28619) also, it is difficult to introduce the blow hole into the scale stably, and it is hard to perform the scale removing process stably.

Further, in these conventional technologies, the possibility of scale detachment by the compression stress occurring during cooling was not considered at all, and the problems of scale detachment during cooling after hot rolling and during storage and transportation (during storage, during transportation) and generation of the rust on the wire rod before MD were involved.

The present invention was developed in view of such circumstances, and its purpose is to provide a steel wire rod in which the scale is hard to detach during cooling after hot rolling and during storage and transportation, and excellent in scale detachment properties during mechanical descaling and excellent in mechanical descaling properties.

The present inventors made intensive investigations to achieve the purpose described above, and came to complete the present invention. According to the present invention, the purpose described above can be achieved.

The present invention which was completed thus and could achieve the purpose described above relates to a steel wire rod, and is the steel wire rod according to the first to eighth aspects of the invention, which is constituted as described below.

That is, the steel wire rod according to a first aspect of the invention is a steel wire rod in which an FeO layer including fine crystal grains having random orientation is formed as inner layer scale on the surface of steel containing C: 0.05-1.2 mass %, Si: 0.01-0.50 mass %, Mn: 0.1-1.5 mass %, P: 0.02 mass % or below (inclusive of 0%), S: 0.02 mass % or below (inclusive of 0%), N: 0.005 mass % or below (inclusive of 0%), an $Fe_2SiO_4$ layer with the thickness: 0.01-1.0 μm is formed in a boundary face between the FeO layer of the inner layer scale and the steel, and the thickness of the inner layer scale is 1-40% of the total scale thickness.

The steel wire rod according to a second aspect of the invention is the steel wire rod according to the first aspect of the invention, in which the maximum grain size of the crystal grain of the inner layer scale is 5.0 μm or below and the average grain size is 2.0 μm or below.

The steel wire rod according to a third aspect of the invention is the steel wire rod according to the first aspect of the invention, in which the steel further contains Cr: 0.3 mass % or below (not inclusive of 0%) and/or Ni: 0.3 mass % or below (not inclusive of 0%). The steel wire rod according to a fourth aspect of the invention is the steel wire rod according to the first aspect of the invention, in which the steel further contains Cu: 0.2 mass % or below (not inclusive of 0%). The steel wire rod according to a fifth aspect of the invention is the steel wire rod according to the first aspect of the invention, in which the steel further contains one or more kinds of the Group 4A elements: 0.1 mass % or below (not inclusive of 0%) in total. The steel wire rod according to a sixth aspect of the invention is the steel wire rod according to the first aspect of the invention, in which the steel further contains B: 0.0001-0.005 mass %. The steel wire rod according to a seventh aspect of the invention is the steel wire rod according to the first aspect of the invention, in which the steel further contains Al: 0.1 mass % or below (not inclusive of 0%). The steel wire rod according to an eighth aspect of the invention is the steel wire rod according to the first aspect of the invention, in which the steel further contains Ca: 0.01 mass % or below (not inclusive of 0%) and/or Mg: 0.01 mass % or below (not inclusive of 0%).

The steel wire rod according to the present invention is hard in detachment of the scale during cooling after hot rolling and during storage and transportation, and excellent in scale detachment properties during mechanical descaling and excellent in mechanical descaling properties. Consequently, according to the steel wire rod in relation with the present invention, generation of the rust due to the scale detachment (exposure of the matrix surface) during cooling after hot rolling and during storage and transportation is inhibited and the rust becomes hard to be generated, and scale removal by mechanical descaling becomes able to be excellently performed.

DETAILED DESCRIPTION OF THE PREFERRED EMBODIMENTS

Figure 1:
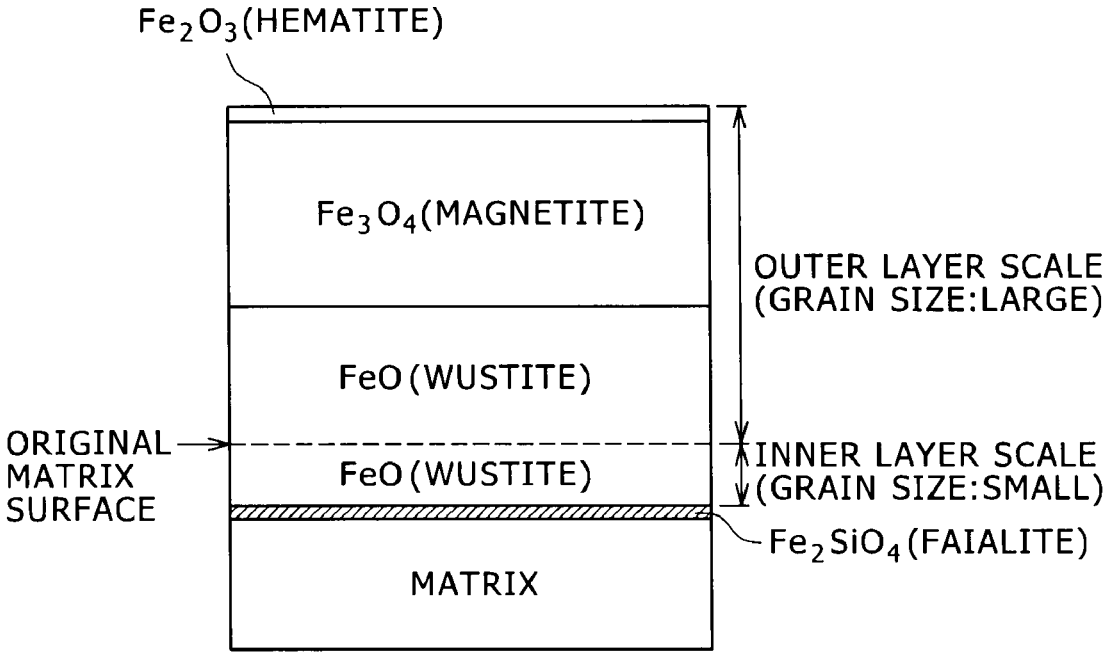
FIG. 1 is a schematic drawing showing the structure of the matrix and the scale.

In the cooling step after hot rolling in the manufacturing process of the steel wire rod, the compression stress generated due to the difference of the heat expansion quantity between the matrix and the scale occurs within the scale, and the scale is naturally detached in the middle of cooling and during coil storage and transportation, which becomes the cause of generation of the rust. Further, although the scale is removed by MD (mechanical descaling) method prior to performing drawing, the dice life is deteriorated if the scale remains, therefore, the steel wire rod having the scale properties of not being detached in the middle of a process and during storage and transportation and being easily detached at the time of MD is hoped for.

MD method is the method in which the strain is applied to the wire rod, a crack is formed within the scale or in the boundary between the wire rod and the scale thereby the scale is detached, and with regard to the physical property value of the conventional scale, FeO ratio is controlled on the scale composition. The reasons are that because the strength of FeO is lower compared with $Fe_2O_3$ and $Fe_3O_4$, the scale composition with more FeO is believed to be more advantageous. However, in order to increase the FeO ratio, the secondary scale needs to be formed at high temperature in general, the scale becomes thick, and the loss of the scale increases. Therefore, it was extremely difficult to make the mutually contradictory characteristics of thin and of the scale properties with high FeO ratio co-exist.

However, as the result of the concentrated and detailed investigations by the present inventors on the scale properties as well as the relation between adhesion properties of the scale and the scale detachment properties by MD, it was found out that if a FeO (wustite) layer with random crystal orientation consisting of fine crystal grains was formed as the inner layer scale, detaching force of the scale was enhanced and the scale was easily detached when the strain was applied during MD, and further, if a $Fe_2SiO_4$ (fayalite) layer was formed in the boundary part of the inner layer scale and the steel, the scale was not detached during cooling after hot rolling and during storage and transportation.

That means, when a FeO layer having random crystal orientation and consisting of fine crystal grains is formed in the inner layer (within the matrix), if strain is applied during MD, a crack is generated from brittle fayalite in the matrix/scale boundary, and because the FeO layer itself is also weak in strength, the scale layer is easily broken, becomes comparatively large foil-like scale, and is detached. Accordingly, because finely pulverized scale powder does not remain on the surface of the wire rod, there is no possibility of causing problems such as generation of a flaw due to lubricating defect in the drawing process and deterioration of the life of the dice. Also, because fayalite improves adhesion properties of the scale, there is an advantage that the scale is not detached during cooling after hot rolling and during storage and transportation. As the result of the intensive investigations, the present inventors obtained the knowledge described above.

The present invention was completed on the basis of the knowledge described above, and is related to a steel wire rod. As described previously, the steel wire rod according to the present invention completed thus is a steel wire rod, in which an FeO layer including fine crystal grains having random orientation is formed as inner layer scale on the surface of steel containing C: 0.05-1.2 mass %, Si: 0.01-0.50 mass %, Mn: 0.1-1.5 mass %, P: 0.02 mass % or below (inclusive of 0%), S: 0.02 mass % or below (inclusive of 0%), N: 0.005 mass % or below (inclusive of 0%), an $Fe_2SiO_4$ layer with the thickness: 0.01-1.0 μm is formed in a boundary face between the FeO layer of the inner layer scale and the steel, and the thickness of the inner layer scale is 1-40% of the total scale thickness.

As understood from the knowledge described above and the like, the steel wire rod in relation with the present invention is hard in detachment of the scale during cooling after hot rolling and during storage and transportation, and excellent in scale detachment properties during MD (mechanical descaling) and excellent in MD properties. Consequently, according to the steel wire rod in relation with the present invention, generation of the rust due to the scale detachment (exposure of the matrix surface) during cooling after hot rolling and during storage and transportation is inhibited and the rust becomes hard to be generated, and excellent performance of scale removal by MD becomes possible.

In other words, in the steel wire rod in relation with the present invention, because the fayalite layer enhances adhesion properties of the entire scale layer and the scale is broken preferentially from the inner layer which is weak in strength during MD, the scale can be removed efficiently, and anti-rust properties and MD properties can co-exist. Because adhesion properties of the entire scale layer is excellent as described above, natural detachment of the scale during cooling after hot rolling and during storage and transportation is inhibited. Also, because it is excellent in MD properties, the scale is easily detached during MD, and even if the scale is thin, detachment properties can be improved and the loss of the scale is less, therefore yield can be maintained high. Further, because scale detachment during MD is easy, sufficient detachment performance can be secured by a simple descaling device, the flaw on the surface of the wire rod and lubricating defect by remaining of the scale become hard to occur, stable drawing condition can be obtained in secondary wire rod makers, and manufacturing of the wire rod with high quality becomes possible.

The reason of numerical limitation of the composition (the reason of limiting content of respective element) of the steel of the steel wire rod in relation with the present invention and preferable contents and the like will be described below.

[C: 0.05-1.2%]

C is a main element to decide the mechanical properties of steel. In order to secure the required strength of the steel wire rod, C quantity needs to be contained by 0.05 mass % (wt %) at least. On the other hand, if C quantity is excessive, hot working properties in wire rod manufacturing is deteriorated, therefore the upper limit is made 1.2% considering the hot working properties. Accordingly, C: 0.05-1.2 mass % (hereinafter referred to also as "%") is stipulated.

[Si: 0.01-0.50%]

Si is an element necessary for deoxidation of steel, and if Si content is too low, formation of $Fe_2SiO_4$ (fayalite) becomes insufficient, therefore the lower limit is made 0.01%. On the other hand, if Si is added excessively, $Fe_2SiO_4$ (fayalite) is formed excessively and the thickness of the $Fe_2SiO_4$ layer exceeds 1.0 μm, therefore mechanical descaling properties are extremely deteriorated and problems such as formation of surface decarburization layer and the like occur, accordingly the upper limit is made 0.5%. Consequently, Si: 0.01-0.5% is stipulated.

[Mn: 0.1-1.5%]

Mn is an element effective in securing quenching properties of steel and enhancing the strength. In order to exert such actions effectively, it is necessary to add it by 0.1% or above. However, if it is added excessively, segregation occurs in the cooling step after hot rolling, and supercooled structure such as martensite which is harmful in drawing workability is liable to be generated, therefore it is necessary to make it 1.5% or below. Consequently, Mn: 0.1-1.5% is stipulated.

[P: 0-0.02%]

P is an element to deteriorate toughness and ductility of steel, and in order to prevent wire breakage during the drawing process and the like, it is necessary to make the upper limit of P quantity 0.02%. Accordingly, P: 0.02% or below (inclusive of 0%) is stipulated. P: 0.01% or below is preferable, and P: 0.005% or below is more preferable.

[S: 0-0.02%]

Similar to P, S is an element to deteriorate toughness and ductility of steel, and in order to prevent wire breakage during the drawing process and the twisting process thereafter, it is necessary to make the upper limit of S quantity 0.02%. Accordingly, S: 0.02% or below (inclusive of 0%) is stipulated. S: 0.01% or below is preferable, and S: 0.005% or below is more preferable.

[N: 0-0.005%]

Because N deteriorates toughness and ductility of a wire rod, N: 0.005% or below (inclusive of 0%) is stipulated.

Also, in order to further improve MD properties and properties such as strength, it is recommendable to add the elements described below, as well as to control the contents of Al, Mg, Ni and the like as described below.

[Cr: Over 0% and 0.3% or Below and/or Ni: Over 0% and 0.3% or Below]

Both of Cr and Ni are elements to enhance quenching properties and to contribute to improvement of the strength. In order to exert such action effects, it is preferable to add Cr and Ni. However, if they are added excessively, martensite is easily generated, adhesion properties of the scale become excessively high, and the scale becomes hard to be detached by mechanical descaling, therefore Cr: over 0% and 0.3% or below and/or Ni: over 0% and 0.3% or below is favorable. These elements may be added in single, or both may be added at the same time.

[Cu: Over 0% and 0.2% or Below]

Cu has the effects of promoting the scale detachment and improving MD properties. In order to exert such action effects, it is recommendable to add Cu. However if it is excessively added, the scale detachment is promoted too much, the scale is detached during rolling, thin adhered scale is generated on the detached face, the rust is generated during coil storage of the wire rod, therefore it is favorable to make the upper limit of Cu content 0.2%.

[One or More Kinds of the Group 4A Elements: Over 0% and 0.1% or Below in Total]

The Group 4A elements (Nb, V, Ti, Hf, Zr) are elements to precipitate fine carbonitrides and contribute to high strengthening. In order to exert such action effects effectively, it is preferable to add one or more kinds of the Group 4A elements, particularly to add by 0.003% or above in total. However, if they are added excessively, ductility is deteriorated, therefore one or more kinds of the Group 4A elements: 0.1% or below in total is favorable. These elements may be added in single, or may be added at the same time.

[B: 0.0001-0.005%]

B is known to inhibit generation of the second layer ferrite by existing as free B dissolved in steel in a solid state, and in order to manufacture the high strength steel, in particular, which require inhibiting the longitudinal crack, addition of B is effective. In order to obtain such action effects, addition of B: 0.001% or above is preferable. However, if it is added over 0.005%, ductility is deteriorated, therefore B: 0.005% or below is favorable.

[Al: Over 0% and 0.1% or Below]

Al is effective as a deoxidizing agent, however, if it is added excessively, oxide-based inclusions such as $Al_2O_3$ and the like are generated much and wire breakage frequently occurs. Therefore, Al: 0.1% or below is favorable.

[Mg: Over 0% and 0.01% or Below]

Mg is effective as a deoxidizing agent, however, if it is added excessively, oxide-based inclusions such as MgO—$Al_2O_3$ and the like are generated much and wire breakage frequently occurs. Therefore, the upper limit of Mg content is favorably made 0.01%.

[Ca: Over 0% and 0.01% or Below]

Ca is an element effective in enhancing anti-corrosion properties of steel products. However, if it is added excessively, workability is deteriorated, therefore the upper limit of Ca content is favorably made 0.01%.

The structure of the scale and the reason of numerical limitation (the reason of limitation of the thickness and the like of the scale) and the like of the steel surface of the steel wire rod in relation with the present invention will be described below.

Figure 2:
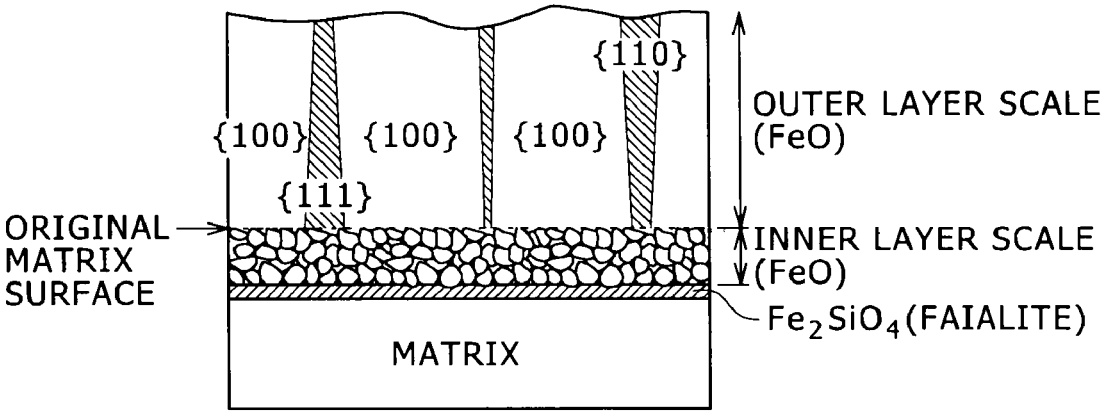
FIG. 2 is a schematic drawing showing the boundary structure of the matrix and the scale.

FIGS. 1 and 2 show the schematic drawings of the structure of the scale. In order to realize the steel wire rod excellent in anti-rust properties (anti-detachment performance, that means, adhesion properties, of the scale during cooling after hot rolling and during storage and transportation) and MD properties (scale detachment properties during MD) in relation with the present invention, it is necessary to form an FeO layer constituted of fine crystal grains having random crystal orientation as an inner layer (the scale formed inside the matrix), and to form a thin $Fe_2SiO_4$ layer in the boundary face between the inner layer scale and the steel (matrix).

Usually, what occupies the major part of the scale is FeO (wustite), and when FeO (wustite) grows as the outer layer scale (the scale formed on the surface of the matrix), the main orientation of the growth of FeO is {100}. The ratio of FeO (wustite) main orientation {100} in the outer layer scale (the ratio of crystal grains having {100} orientation against all crystal grains constituting the outer layer scale) is approximately 20% or above. On the other hand, the ratio of {100} orientation against all FeO (wustite) crystal grains constituting the inner layer scale is 10% or below. Consequently, by analyzing crystal orientation by EBSP (Electron Back Scattering Pattern), the outer layer scale and inner layer scale can be distinguished.

The texture of the scale largely affects the detachment properties of the scale. If the crystal grains of {111}, {110} planes with different growth speed increase within the crystal of {100} plane which is the growth orientation of the scale, the scale becomes of fine crystal structure with random orientation, compression stress within the scale increases and detachment force of the scale is enhanced, thereby MD properties improves.

The present inventors investigated the scale structure in which detachment properties of the scale by MD was improved while the scale was not detached during cooling after hot rolling and during storage and transportation. As the result of it, it was learned that, if the scale was formed in high dew point atmosphere such as the water vapor and the like, an FeO layer constituted of fine crystal grains having random orientation with different growth orientation was formed in the matrix as an inner layer, and a $Fe_2SiO_4$ layer was formed in the boundary face between the inner layer scale (FeO) and the matrix by reaction of $SiO_2$ within the matrix and the water vapor ($2[Fe]+[SiO_2]+2[H_2O]=[Fe_2SiO_4]+2[H_2]$). Also, it was found out that MD properties were enhanced by the effect of the inner layer scale (FeO), adhesion properties of the scale were increased by $Fe_2SiO_4$, and the scale was not detached during cooling after hot rolling and during storage and transportation.

The ratio of the thickness of the inner layer scale against the thickness of the entire scale (outer layer scale+inner layer scale) is favorably 1-40%. If it is below 1%, formation of the inner layer scale is not sufficient, and MD properties are not improved. On the other hand, if it exceeds 40%, the inner layer scale grows too much, and the thickness of the entire scale increases too much, therefore the scale loss increases, and the scale cannot be removed sufficiently, thereby MD properties are deteriorated. Therefore, the thickness of the inner layer scale is made 1-40% of the thickness of the entire scale.

As the maximum grain size ($D_{max}$) and average grain size ($D_{ave}$) of the crystal grains constituting the inner layer scale described above become fine, the ratio of the crystal grains with different growth orientation increases, and detachment properties of the scale (MD properties) are enhanced. The average grain size ($D_{ave}$) is preferably 2.0 μm or below, and the maximum grain size ($D_{max}$) is preferably 5.0 μm or below (the second aspect of the invention). Also, in the outer layer scale, large grains of approximately 5-15 μm grow perpendicularly to the surface of the matrix.

In order to improve adhesion properties of the scale during cooling after hot rolling and during storage and transportation, it is necessary to form the $Fe_2SiO_4$ layer thin. To exert the adhesion properties improving effect, the $Fe_2SiO_4$ layer of thickness: 0.01-1.0 μm is made to form in the boundary face of the inner layer scale and the steel. The adhesion properties improving effect is not exerted if the thickness of the $Fe_2SiO_4$ layer is below 0.01 μm, and adhesion properties with the steel is enhanced too much and the scale cannot be detached by MD if it exceeds 1.0 μm. Therefore, the thickness of the $Fe_2SiO_4$ layer: 0.01-1.0 μm is stipulated.

As described above, if the scale is formed in high dew point atmosphere such as the water vapor and the like, an FeO layer constituted of fine crystal grains having random orientation is formed in the matrix as an inner layer scale, and an $Fe_2SiO_4$ layer is formed in the boundary face between the inner layer scale (FeO) and the matrix. At this time, the dew point of the atmosphere necessary to secure the inner layer scale sufficiently is 30-80° C. The time is favorably 2 s or shorter, and if it exceeds 2 s, conversion into magnetite proceeds, the inner layer scale (FeO) decreases, and MD properties are deteriorated.

EXAMPLES

The examples according to the present invention and the comparative examples will be described below. In this regard, the present invention is not limited to these examples, and implementations appropriately adding alterations within the range adaptable to the purpose of the present invention are also possible, and all of which are to be included within the technical range of the present invention.

The steel wire rods were manufactured as described below using the billets of the composition shown in Tables 1-2. First, the billet is heated and rolled. That is, the billet is heated for 30 min or shorter at a low temperature of 800-900° C. to inhibit formation of fayalite in the heating furnace, then is heated rapidly at 5° C./min or above up to 1,100-1,200° C., is discharged from the heating furnace, and immediately after it, is subjected to descaling by high pressure water of 3 MPa or above, and is subjected to ordinary hot rolling (rough rolling-finish rolling).

In order to form the inner layer scale sufficiently, soon after the finish rolling in the hot rolling described above, descaling is performed by high pressure water of 3 MPa or above for removing the scale entirely, thereafter the wire rod is oxidized for 2 s or shorter in high dew point atmosphere and the inner layer scale is formed. Then, the wire rod is cooled to 750-1,000° C. and is wound. When the wound wire rod is consecutively dropped onto a conveyor scatteringly, the surface of the wire rod is oxidized again in high dew point atmosphere and is cooled immediately down to approximately 600° C. at the speed of 1° C./sec or above, preferably 5° C./sec or above, thereby the inner layer scale and the $Fe_2SiO_4$ layer of a desired thickness can be obtained while maintaining high FeO ratio (because the surface is oxidized and does not convert to $Fe_3O_4$, the inner layer scale is not decreased).

The manufacturing conditions of the steel wire rods described above are shown in Table 3. That means, the temperature (soaking temperature) and the time of heating the billet described above, the temperature raising speed in the rapid heating after this heating, and the temperature of discharging from the heating furnace are shown in the column of the heating furnace condition of Table 3. The dew point of the atmosphere and the time of oxidation in oxidation in high dew point atmosphere after descaling by high pressure water after the finish rolling described above (hereinafter referred to also as "oxidation in high dew point atmosphere after finish rolling") are shown in the column of high dew point oxidation condition/after finish rolling of Table 3. The temperature of winding of the wire rod, the dew point of the atmosphere in oxidation of the wound wire rod in high dew point atmosphere (hereinafter referred to also as "oxidation in high dew point atmosphere after winding") and the cooling speed after the oxidation are shown in the column of high dew point oxidation condition/after winding of Table 3. Further, in the cases of (e), (h) of Table 3, the dew point of the atmosphere in oxidation in high dew point atmosphere after finish rolling and after winding is too high and not appropriate, and in the cases of (f), (g), the dew point of the atmosphere in oxidation is too low and not appropriate. In the case of (d), the oxidation time in oxidation in high dew point atmosphere after finish rolling is too long and not appropriate, therefore oxidation of the surface proceeds and conversion into magnetite proceeds, thereby the inner layer scale decreases and MD properties deteriorates.

The properties of the steel wire rods were investigated as described below. Distinction of the inner layer and outer layer scale was investigated by analyzing the orientation using EBSP (Electron Back Scattering Pattern). More specifically, the layer with 20% or above percentage of {100} orientation was regarded as the outer layer scale, and the layer with 10% or below was regarded as the inner layer scale. The device used for it was an SU-70 Field Emission Type Scanning Electron Microscope (FE-SEM) made by Hitachi, Ltd., and measurement was carried out with 0.05 μm measuring step and accelerating voltage: 15 kV. One piece each of the sample was taken from respective 3 steel wire rods described above, EBSP measurement was performed with 10,000 times field of view, the maximum grain size and average grain size of the inner layer scale were measured respectively, and the average value was obtained.

With respect to the forming condition of the $Fe_2SiO_4$ layer, the sample for cross-section observation was taken from one location each of the tip, center and tail of the wire rod coil, respective 4 locations of each sample were photographed with 20,000 times field of view by the electron microscope (FE-SEM), the thickness of the $Fe_2SiO_4$ layer was measured, and the average value was obtained.

With respect to the detachment condition of the scale (adhesion properties of the scale) of the wire rod in as hot-rolled state, each 3 wire rods with 250 mm length each were taken from the tip, center and tail of the wire rod coil, the outer appearance of the surface of the outer peripheral face and inner peripheral face of the wire rod were photographed by a digital camera, the area ratio (%) of a part where the scale had been detached was computed by an image analysis processing software, and the average value was obtained. The adhesion properties of the scale were judged to have passed if the detachment ratio of the scale was 3% or below.

MD properties of the steel wire rod were investigated as described below. After the steel wire rod was cut by 250 mm length, tensile load was applied until dislocation of the cross head becomes 12 mm with 200 mm inter-chuck distance (applying 6% tensile strain), thereafter the steel wire rod was detached from the chuck. The scale on the surface of the wire rod was blown off by air blow to the sample detached from the chuck, then the sample was cut to 200 mm length to measure the weight to obtain the weight (W1), was immersed in hydrochloric acid for entirely detaching the scale adhered to the surface of the wire rod, and the weight was measured again to obtain the weight (W2). Based on the values of the measured weight, the remained scale quantity (the remaining quantity of the scale) was obtained by Equation (1) shown below. As this remaining quantity of the scale is more, MD properties are inferior, and MD properties were judged to be good for those whose remaining quantity of the scale was 0.05 mass % [weight % (wt %)] or below.

$$\text{Remaining scale quantity(weight \%)}=100\times(W1-W2)/W1 \quad \text{Equation (1)}$$

The result of the measurement described above is shown in Tables 4-6. As is understood from Tables 4-6, in the cases of No. 1, Nos. 2, 4-28, 30-32, 34, 35, 37-39, 41, 42, 44, 45, 48, 51, because the heating furnace condition (that means, the heating temperature and heating time of the billet) the oxidation condition in high dew point atmosphere after finish rolling and the oxidation condition in high dew point atmosphere after winding are appropriate, the inner layer scale satisfying the thickness of the inner layer (1-40% of the total thickness of the scale) which is the requisite of the steel wire rod in relation with the present invention is formed and the $Fe_2SiO_4$ layer satisfying the thickness of the $Fe_2SiO_4$ layer (0.01-1.0 μm) which is the requisite of the steel wire rod in relation with the present invention is formed in the boundary face between the inner layer scale and the steel, the scale is hard to be detached as the scale is excellent in adhesion properties during cooling after hot rolling and during storage and transportation, and the scale detachment properties are excellent during MD and the wire rod is excellent in MD properties (all of them are the examples of the present invention). That means, in these cases, the detachment ratio of the scale of the wire rod in as hot-rolled state (scale detachment ratio of the rolled product) is 3% or below which is "acceptable", and MD properties are excellent because the scale remaining quantity in the MD properties test is 0.05 wt % or below.

In the case of No. 29, the oxidation time in oxidation in high dew point atmosphere after finish rolling was too long and oxidation of $FeO \rightarrow Fe_3O_4$ proceeded, the inner layer scale (FeO) decreased, therefore MD properties deteriorated. That means, because the thickness of the inner layer scale is small and the thickness of the inner layer scale (1-40% of the total thickness of the scale) which is the requisite of the steel wire rod in relation with the present invention is not satisfied, the scale remaining quantity in the MD properties test exceeds 0.05 wt % and MD properties are not good (comparative example).

In the case of No. 33, because the winding temperature of the wire rod was high, the temperature in oxidation in high dew point atmosphere after winding was too high, therefore both of the outer layer and inner layer scale were formed excessively, the scale was detached intensively after rolling and the rust was generated although MD properties were excellent. That means, because the thickness of the inner layer scale is large and the thickness of the inner layer scale (1-40% of the total thickness of the scale) which is the requisite of the steel wire rod in relation with the present invention is not satisfied, the scale detachment ratio of the rolled product exceeds 3% which is "not acceptable" (comparative example).

In the case of No. 36, the dew point in oxidation in high dew point atmosphere after finish rolling was too high, the inner layer scale was formed excessively, the scale was detached intensively after rolling and the rust was generated although MD properties were excellent. That means, because the thickness of the inner layer scale is large and the thickness of the inner layer scale (1-40%, of the total thickness of the scale) which is the requisite of the steel wire rod in relation with the present invention is not satisfied, the scale detachment ratio of the rolled product exceeds 3% which is "not acceptable" (comparative example).

In the case of No. 40, the soaking temperature in the heating furnace was too high, fayalite was formed excessively in the heating furnace, and MD properties deteriorated. That means, because the thickness of the $Fe_2SiO_4$ layer is large and does not satisfy the thickness of the $Fe_2SiO_4$ layer (0.01-1.0 μm) which is the requisite of the steel wire rod in relation with the present invention, the scale remaining quantity in the MD properties test exceeds 0.05 wt % and MD properties are not good (comparative example).

In the cases of Nos. 3, 43, the dew point in oxidation in high dew point atmosphere after winding was too high, the inner layer scale was formed excessively, the scale was detached intensively after rolling and the rust was generated although MD properties were excellent. That means, because the thickness of the inner layer scale is large and the thickness of the inner layer scale (1-40% of the total thickness of the scale) which is the requisite of the steel wire rod in relation with the present invention is not satisfied, the scale detachment ratio of the rolled product exceeds 3% which is "not acceptable" (comparative example).

In the case of No. 46, the dew point in oxidation in high dew point atmosphere after finish rolling was too low and formation of the inner layer scale was less, formation of fayalite was less, and both MD properties and anti-rust properties deteriorated. That means, because the thickness of the $Fe_2SiO_4$ layer is small and the thickness of the $Fe_2SiO_4$ layer (0.01-1.0 μm) which is the requisite of the steel wire rod in relation with the present invention is not satisfied, the scale detachment ratio of the rolled product exceeds 3% which is "not acceptable". Also, because the thickness of the inner layer scale is small and the thickness of the inner layer scale (1-40% of the total thickness of the scale) which is the requisite of the steel wire rod in relation with the present invention is not satisfied, the scale remaining quantity in the MD properties test exceeds 0.05 wt % and MD properties are not good (comparative example).

In the case of No. 47, because winding was conducted under high temperature, the temperature in oxidation in high dew point atmosphere after winding was too high, therefore both of the outer layer and inner layer scale were formed excessively, the scale was detached intensively after rolling and the rust was generated although MD properties were excellent. That means, because the thickness of the inner layer scale is large and the thickness of the inner layer scale (1-40% of the total thickness of the scale) which is the requisite of the steel wire rod in relation with the present invention is not satisfied, the scale detachment ratio of the rolled product exceeds 3% which is "not acceptable" (comparative example).

In the case of No. 49, the dew point in oxidation in high dew point atmosphere after winding was too low, formation of the inner layer scale was less and formation of fayalite was less, and both MD properties and anti-rust properties deteriorated. That means, because the thickness of the $Fe_2SiO_4$ layer is small and does not satisfy the thickness of the $Fe_2SiO_4$ layer (0.01-1.0 μm) which is the requisite of the steel wire rod in relation with the present invention, the scale detachment ratio of the rolled product exceeds 3% which is "not acceptable". Also, because the thickness of the inner layer scale is small and the thickness of the inner layer scale (1-40% of the total thickness of the scale) which is the requisite of the steel wire rod in relation with the present invention is not satisfied, the scale remaining quantity in the MD properties test exceeds 0.05 wt % and MD properties are not good (comparative example).

In the case of No. 50, the discharging temperature from the heating furnace was too high and fayalite was formed excessively, and MD properties deteriorated. That means, because the thickness of the $Fe_2SiO_4$ layer is large and does not satisfy the thickness of the $Fe_2SiO_4$ layer (0.01-1.0 μm) which is the requisite of the steel wire rod in relation with the present invention, the scale remaining quantity in the MD properties test exceeds 0.05 wt % and MD properties are not good (comparative example).

TABLE 1

(mass %)

| Steel kind | C | Si | Mn | P | S | N | Cr | Ni | Cu | Al | B | Others |
|---|---|---|---|---|---|---|---|---|---|---|---|---|
| A-1 | 0.43 | 0.15 | 0.87 | 0.009 | 0.005 | 0.003 | — | — | — | — | — | — |
| A-2 | 0.43 | 0.15 | 0.87 | 0.009 | 0.005 | 0.003 | 0.24 | — | — | — | — | — |
| A-3 | 0.43 | 0.15 | 0.87 | 0.009 | 0.005 | 0.003 | — | 0.17 | — | — | — | — |
| A-4 | 0.43 | 0.15 | 0.87 | 0.009 | 0.005 | 0.003 | — | — | 0.13 | — | — | — |
| A-5 | 0.43 | 0.15 | 0.87 | 0.009 | 0.005 | 0.003 | — | — | — | 0.036 | — | — |
| A-6 | 0.43 | 0.15 | 0.87 | 0.009 | 0.005 | 0.003 | — | — | — | — | 0.0007 | — |
| A-7 | 0.43 | 0.15 | 0.87 | 0.009 | 0.005 | 0.003 | — | — | — | — | — | Ca = 0.006 |
| A-8 | 0.43 | 0.15 | 0.87 | 0.009 | 0.005 | 0.003 | — | — | — | — | — | Mg = 0.002 |
| A-9 | 0.43 | 0.15 | 0.87 | 0.009 | 0.005 | 0.003 | — | — | — | — | — | Nb = 0.01 |
| A-10 | 0.43 | 0.15 | 0.87 | 0.009 | 0.005 | 0.003 | — | — | — | — | — | V = 0.07 |
| A-11 | 0.43 | 0.15 | 0.87 | 0.009 | 0.005 | 0.003 | — | — | — | — | — | Ti = 0.05 |
| A-12 | 0.43 | 0.15 | 0.87 | 0.009 | 0.005 | 0.003 | — | — | — | — | — | Hf = 0.07 |
| A-13 | 0.43 | 0.15 | 0.87 | 0.009 | 0.005 | 0.003 | — | — | — | — | — | Zr = 0.06 |
| A-14 | 0.43 | 0.15 | 0.87 | 0.009 | 0.005 | 0.003 | 0.15 | 0.03 | — | — | — | — |
| A-15 | 0.43 | 0.15 | 0.87 | 0.009 | 0.005 | 0.003 | 0.08 | 0.13 | 0.07 | — | — | — |
| A-16 | 0.43 | 0.15 | 0.87 | 0.009 | 0.005 | 0.003 | 0.11 | 0.09 | — | 0.011 | — | — |
| A-17 | 0.43 | 0.15 | 0.87 | 0.009 | 0.005 | 0.003 | 0.08 | 0.25 | — | — | 0.0011 | — |

TABLE 2

(mass %)

| Steel kind | C | Si | Mn | P | S | N | Cr | Ni | Cu | Al | B | Others |
|---|---|---|---|---|---|---|---|---|---|---|---|---|
| A-18 | 0.43 | 0.15 | 0.87 | 0.009 | 0.005 | 0.003 | 0.17 | 0.08 | — | — | — | Ti = 0.07 |
| A-19 | 0.43 | 0.15 | 0.87 | 0.009 | 0.005 | 0.003 | 0.14 | — | 0.05 | — | — | — |
| A-20 | 0.43 | 0.15 | 0.87 | 0.009 | 0.005 | 0.003 | 0.25 | — | 0.14 | 0.028 | — | — |
| A-21 | 0.43 | 0.15 | 0.87 | 0.009 | 0.005 | 0.003 | — | 0.15 | 0.09 | — | — | — |
| A-22 | 0.43 | 0.15 | 0.87 | 0.009 | 0.005 | 0.003 | — | 0.28 | 0.17 | 0.035 | — | — |
| A-23 | 0.43 | 0.15 | 0.87 | 0.009 | 0.005 | 0.003 | — | 0.12 | 0.06 | — | 0.0009 | — |
| A-24 | 0.43 | 0.15 | 0.87 | 0.009 | 0.005 | 0.003 | — | 0.07 | 0.15 | — | — | Hf = 0.05 |
| B | 0.05 | 0.06 | 0.16 | 0.002 | 0.006 | 0.0014 | — | — | — | 0.014 | 0.0002 | Mg = 0.003 |
| C | 0.16 | 0.09 | 0.43 | 0.004 | 0.001 | 0.0027 | 0.13 | 0.01 | — | 0.023 | — | — |
| D | 0.33 | 0.31 | 0.78 | 0.002 | 0.003 | 0.0011 | — | — | — | — | — | Ti = 0.02 |
| E | 0.62 | 0.33 | 0.69 | 0.002 | 0.004 | 0.0013 | — | 0.03 | 0.03 | 0.001 | 0.0006 | Ti = 0.03, Nb = 0.02 |

TABLE 2-continued (mass %)

| Steel kind | C | Si | Mn | P | S | N | Cr | Ni | Cu | Al | B | Others |
|---|---|---|---|---|---|---|---|---|---|---|---|---|
| F | 0.85 | 0.28 | 0.53 | 0.002 | 0.003 | 0.0020 | 0.03 | — | 0.02 | 0.032 | — | — |
| G | 0.91 | 0.25 | 0.64 | 0.002 | 0.003 | 0.0012 | 0.15 | 0.28 | 0.03 | — | — | Ca = 0.003 |
| H | 0.99 | 0.31 | 0.54 | 0.005 | 0.003 | 0.0011 | 0.26 | 0.02 | 0.16 | 0.002 | 0.0021 | Ti = 0.02, Hf = 0.02 |
| I | 1.19 | 0.32 | 0.98 | 0.002 | 0.001 | 0.0020 | 0.03 | 0.14 | 0.12 | 0.001 | 0.0034 | V = 0.03 |
| J | 1.03 | 0.49 | 1.3 | 0.001 | 0.004 | 0.0021 | 0.21 | 0.13 | 0.03 | 0.004 | 0.0004 | Zr = 0.02, Nb = 0.04 |

TABLE 3

| | Heating furnace condition | | | | High dew point oxidation condition | | | | | Remarks |
|---|---|---|---|---|---|---|---|---|---|---|
| | | | | | After finish rolling | | After winding | | | |
| Symbol | Soaking temperature (° C.) | Time (min) | Temperature raising speed in rapid heating (° C./min) | Discharging temperature (° C.) | Dew point (° C.) | Time (sec) | Temperature (° C.) | Dew point (° C.) | Cooling speed (° C./s) | (Example of the invention is obtainable: ○, not obtainable: x) |
| a | 850 | 25 | 15 | 1120 | 59 | 0.3 | 765 | 64 | 1 | ○ |
| b | 805 | 18 | 25 | 1200 | 51 | 0.7 | 900 | 52 | 7 | ○ |
| c | 890 | 15 | 10 | 1180 | 40 | 0.9 | 980 | 38 | 15 | ○ |
| d | 825 | 10 | 6 | 1100 | 53 | 2.8 | 920 | 47 | 10 | x |
| e | 845 | 15 | 13 | 1145 | 88 | 0.5 | 910 | 55 | 15 | x |
| f | 860 | 22 | 19 | 1180 | 23 | 0.7 | 870 | 48 | 10 | x |
| g | 900 | 10 | 7 | 1160 | 55 | 0.6 | 890 | 19 | 5 | x |
| h | 875 | 24 | 20 | 1190 | 58 | 0.3 | 850 | 83 | 8 | x |
| i | 836 | 19 | 28 | 1186 | 42 | 0.9 | 1050 | 53 | 8 | x |
| j | 1050 | 25 | 7 | 1150 | 55 | 0.5 | 790 | 56 | 3 | x |
| k | 870 | 22 | 10 | 1300 | 38 | 0.9 | 865 | 64 | 10 | x |

TABLE 4

| | | | | | Inner layer scale percentage, grain size, {100} orientation percentage | | | | | Scale properties | | |
|---|---|---|---|---|---|---|---|---|---|---|---|---|
| No. | Steel kind | Manufacturing condition | Thickness of entire scale (outer layer + inner layer) (μm) | Inner layer scale thickness (μm) | Inner layer scale percentage (%) | Dmax (μm) | Dave (μm) | {100} percentage (%) | $Fe_2SiO_4$ layer thickness (μm) | Scale detachment ratio of rolled product (%) | Scale remaining quantity by MD (wt %) | Remarks |
| 1 | A-1 | a | 8 | 1.1 | 13 | 0.23 | 0.08 | 3.6 | 0.09 | 2.1 | 0.006 | Example |
| 2 | A-1 | b | 9 | 1.3 | 14 | 0.41 | 0.11 | 4.7 | 0.15 | 1.6 | 0.005 | Example |
| 3 | A-1 | h | 10 | 5.2 | 52 | 3.2 | 0.9 | 7.6 | 0.19 | 10.2 | 0.001 | Comparative example |
| 4 | A-2 | c | 7 | 0.9 | 13 | 0.71 | 0.51 | 4.1 | 0.05 | 0.8 | 0.008 | Example |
| 5 | A-3 | a | 8 | 0.9 | 11 | 0.54 | 0.25 | 3.8 | 0.03 | 2.4 | 0.009 | Example |
| 6 | A-4 | c | 10 | 1.3 | 13 | 0.82 | 0.39 | 3.1 | 0.07 | 0.5 | 0.011 | Example |
| 7 | A-5 | a | 9 | 1.5 | 17 | 0.46 | 0.26 | 4.4 | 0.08 | 1.5 | 0.014 | Example |
| 8 | A-6 | b | 8 | 0.8 | 10 | 0.23 | 0.14 | 5.6 | 0.11 | 0.8 | 0.008 | Example |
| 9 | A-7 | b | 8 | 1.6 | 20 | 0.96 | 0.68 | 5.9 | 0.07 | 0.6 | 0.002 | Example |
| 10 | A-8 | c | 7 | 1.2 | 17 | 0.55 | 0.31 | 6.4 | 0.05 | 1.1 | 0.015 | Example |
| 11 | A-9 | a | 9 | 0.9 | 10 | 0.33 | 0.12 | 4.8 | 0.08 | 1.7 | 0.021 | Example |
| 12 | A-10 | b | 8 | 0.7 | 9 | 0.26 | 0.09 | 3.5 | 0.16 | 0.8 | 0.013 | Example |
| 13 | A-11 | c | 9 | 1.6 | 18 | 0.78 | 0.45 | 4.9 | 0.11 | 0.9 | 0.004 | Example |
| 14 | A-12 | b | 10 | 1.8 | 18 | 0.99 | 0.57 | 5.2 | 0.08 | 2.8 | 0.007 | Example |

TABLE 5

| No. | Steel kind | Manufacturing condition | Thickness of entire scale (outer layer + inner layer) (μm) | Inner layer scale thickness (μm) | Inner layer scale percentage (%) | Dmax (μm) | Dave (μm) | {100} percentage (%) | $Fe_2SiO_4$ layer thickness (μm) | Scale detachment ratio of rolled product (%) | Scale remaining quantity by MD (wt %) | Remarks |
|---|---|---|---|---|---|---|---|---|---|---|---|---|
| | | | | | Inner layer scale percentage, grain size, {100} orientation percentage | | | | | Scale properties | | |
| 15 | A-13 | c | 11 | 2.1 | 19 | 1.4 | 0.66 | 6.7 | 0.03 | 2.1 | 0.015 | Example |
| 16 | A-14 | a | 10 | 1.3 | 13 | 0.72 | 0.34 | 3.8 | 0.08 | 1.8 | 0.013 | Example |
| 17 | A-15 | b | 8 | 0.8 | 10 | 0.21 | 0.09 | 3.2 | 0.1 | 0.8 | 0.024 | Example |
| 18 | A-16 | b | 7 | 0.6 | 9 | 0.15 | 0.08 | 2.8 | 0.07 | 1.4 | 0.018 | Example |
| 19 | A-17 | c | 9 | 0.8 | 9 | 0.43 | 0.28 | 3.6 | 0.04 | 0.6 | 0.009 | Example |
| 20 | A-18 | a | 10 | 1.9 | 19 | 1.1 | 0.63 | 4.8 | 0.15 | 2.3 | 0.016 | Example |
| 21 | A-19 | b | 9 | 1.4 | 16 | 0.88 | 0.42 | 5.3 | 0.12 | 1.3 | 0.023 | Example |
| 22 | A-20 | c | 8 | 1.1 | 14 | 0.53 | 0.35 | 3.7 | 0.07 | 1.9 | 0.016 | Example |
| 23 | A-21 | c | 8 | 1.2 | 15 | 0.46 | 0.19 | 2.9 | 0.04 | 1.6 | 0.006 | Example |
| 24 | A-22 | a | 12 | 1.7 | 14 | 0.75 | 0.58 | 3.4 | 0.08 | 2.6 | 0.005 | Example |
| 25 | A-23 | b | 10 | 1.4 | 14 | 0.64 | 0.47 | 2.5 | 0.06 | 2.4 | 0.004 | Example |
| 26 | A-24 | c | 8 | 0.6 | 8 | 0.38 | 0.16 | 4.6 | 0.13 | 0.8 | 0.007 | Example |
| 27 | B | b | 13 | 0.3 | 2 | 0.23 | 0.15 | 5.4 | 0.06 | 2.5 | 0.008 | Example |
| 28 | B | a | 8 | 0.6 | 7 | 0.35 | 0.21 | 2.2 | 0.12 | 0.7 | 0.012 | Example |
| 29 | B | d | 11 | 0.03 | 0.3 | — | — | — | 0.09 | 1.4 | 0.19 | Comparative example |
| 30 | C | a | 9 | 0.3 | 3 | 0.15 | 0.09 | 2.9 | 0.07 | 2.2 | 0.021 | Example |
| 31 | C | b | 12 | 0.6 | 5 | 0.54 | 0.33 | 7.2 | 0.02 | 0.5 | 0.014 | Example |
| 32 | D | b | 9 | 0.7 | 8 | 0.7 | 0.43 | 6.1 | 0.05 | 1.1 | 0.009 | Example |

TABLE 6

| No. | Steel kind | Manufacturing condition | Thickness of entire scale (outer layer + inner layer) (μm) | Inner layer scale thickness (μm) | Inner layer scale percentage (%) | Dmax (μm) | Dave (μm) | {100} percentage (%) | $Fe_2SiO_4$ layer thickness (μm) | Scale detachment ratio of rolled product (%) | Scale remaining quantity by MD (wt %) | Remarks |
|---|---|---|---|---|---|---|---|---|---|---|---|---|
| | | | | | Inner layer scale percentage, grain size, {100} orientation percentage | | | | | Scale properties | | |
| 33 | D | i | 30 | 16 | 52 | 6.1 | 2.7 | 3.8 | 0.18 | 9.1 | 0.001 | Comparative example |
| 34 | E | a | 10 | 0.9 | 9 | 0.82 | 0.46 | 2.6 | 0.23 | 1.8 | 0.013 | Example |
| 35 | E | b | 7 | 1.1 | 15 | 0.7 | 0.32 | 4.5 | 0.09 | 0.8 | 0.009 | Example |
| 36 | E | e | 12 | 5.4 | 45 | 3.8 | 1.9 | 5.8 | 0.02 | 6.2 | 0.001 | Comparative example |
| 37 | F | a | 10 | 1.6 | 16 | 1.3 | 0.5 | 4.3 | 0.34 | 2.3 | 0.01 | Example |
| 38 | F | b | 9 | 1.8 | 20 | 1.5 | 0.5 | 4.9 | 0.42 | 1.9 | 0.008 | Example |
| 39 | F | c | 14 | 5.4 | 39 | 4.9 | 1.8 | 6.2 | 0.66 | 1.4 | 0.038 | Example |
| 40 | F | j | 13 | 3.5 | 26 | 2.7 | 1.1 | 3.4 | 2.5 | 0.3 | 0.3 | Comparative example |
| 41 | G | b | 8 | 2.2 | 26 | 2 | 0.56 | 7.6 | 0.03 | 1.6 | 0.014 | Example |
| 42 | G | c | 7 | 2 | 30 | 2 | 0.7 | 3.9 | 0.49 | 0.2 | 0.012 | Example |
| 43 | G | h | 9 | 4.4 | 49 | 2.5 | 1.4 | 8.4 | 0.59 | 4.9 | 0.001 | Comparative example |
| 44 | H | c | 7 | 2 | 29 | 2.1 | 0.5 | 6.5 | 0.68 | 1.4 | 0.008 | Example |
| 45 | H | b | 8 | 2.8 | 35 | 1.8 | 0.9 | 7.2 | 0.59 | 0.2 | 0.004 | Example |
| 46 | H | f | 8 | 0.04 | 0.5 | — | — | — | 0.005 | 5.6 | 0.055 | Comparative example |
| 47 | H | i | 9 | 5 | 56 | 10 | 5.5 | 7.3 | 0.98 | 6.3 | 0.001 | Comparative example |
| 48 | I | b | 7 | 1.7 | 24 | 1.4 | 0.35 | 6.2 | 0.12 | 0.7 | 0.018 | Example |
| 49 | I | g | 8 | 0.01 | 0.1 | — | — | — | 0.007 | 4.2 | 0.22 | Comparative example |
| 50 | J | k | 28 | 10.1 | 36 | 2.2 | 0.8 | 7.8 | 1.2 | 2.2 | 0.11 | Comparative example |
| 51 | J | c | 9 | 2.3 | 25 | 1.5 | 0.4 | 8.6 | 0.92 | 0.7 | 0.013 | Example |

The steel wire rod in relation with the present invention can be very appropriately used as the steel wire rod for steel wire manufacturing (raw wire rod) and is very useful because the scale is hardly detached and the rust is hardly generated during cooling after hot rolling and during storage and transportation, and scale detachment properties are excellent during MD and MD properties are excellent.

What is claimed is:

1. A steel wire rod comprising C: 0.05-1.2 mass %, Si: 0.01-0.50 mass %, Mn: 0.1-1.5 mass %, P: 0.02 mass % or below (inclusive of 0%), S: 0.02 mass % or below (inclusive of 0%), N: 0.005 mass % or below (inclusive of 0%), and the balance of iron and inevitable impurities in which the steel wire rod has an $Fe_2Sia_4$ layer formed on its surface, an inner layer scale formed on an outer surface of the $Fe_2SiO_4$ layer, and an outer layer scale formed on an outer surface of the inner layer scale, the inner layer scale comprises an FeO layer comprising fine crystal grains having random orientation, formed at the outer surface of the $Fe_2SiO_4$ layer, the outer layer scale comprises an FeO layer formed at the outer surface of the FeO layer of the inner layer scale, an $Fe_3O_4$ layer formed on the outer surface thereof and an $Fe_2O_3$ layer formed on the outer surface of the $Fe_3O_4$ layer, the inner layer scale having a thickness that is 1-40% of the thickness of the entire scale, which is the thickness of the inner layer scale+the outer layer scale, the $Fe_2SiO_4$ layer having a thickness of from 0.01-1.0 μm, a ratio of {100} orientation occupying the entire FeO crystal grains of the inner layer scale is 10% or less, and a ratio of {100} orientation occupying the entire FeO crystal grains of the outer layer scale is 20% or more.

2. The steel wire rod according to claim 1, wherein the maximum grain size of the crystal grain of the inner layer scale is 5.0 μm or below and the average grain size is 2.0 μm or below.

3. The steel wire rod according to claim 1, wherein the steel wire rod further contains Cr: 0.3 mass % or below (not inclusive of 0%) and/or Ni: 0.3 mass % or below (not inclusive of 0%).

4. The steel wire rod according to claim 1, wherein the steel wire rod further contains Cu: 0.2 mass % or below (not inclusive of 0%).

5. The steel wire rod according to claim 1, wherein the steel wire rod further contains one or more Group 4A elements: 0.1 mass % or below (not inclusive of 0%) in total.

6. The steel wire rod according to claim 1, wherein the steel wire rod further contains B: 0.0001-0.005 mass %.

7. The steel wire rod according to claim 1, wherein the steel wire rod further contains Al: 0.1 mass % or below (not inclusive of 0%).

8. The steel wire rod according to claim 1, wherein the steel wire rod further contains Ca: 0.01 mass % or below (not inclusive of 0%) and/or Mg: 0.01 mass % or below (not inclusive of 0%).

9. The steel wire rod according to claim 1, wherein P: 0.01 mass % or below (inclusive of 0%).

10. The steel wire rod according to claim 1, wherein P: 0.005 mass % or below (inclusive of 0%).

11. The steel wire rod according to claim 1, wherein S: 0.01 mass % or below (inclusive of 0%).

12. The steel wire rod according to claim 1, wherein S: 0.005 mass % or below (inclusive of 0%).

13. The steel wire rod according to claim 1, wherein the wire rod exhibits a scale detachment ratio of rolled product of 3% or below, and a scale remaining quantity by mechanical descaling of 0.05 wt % or below.

* * * * *